US005571274A

United States Patent [19]

Holstensson

[11] Patent Number: 5,571,274

[45] Date of Patent: Nov. 5, 1996

[54] ARM-REST DEVICE FOR A CHAIR

[75] Inventor: Lars Holstensson, Nässjö , Sweden

[73] Assignee: Ergonomiprodukter I Bodafors AB, Nässjö, Sweden

[21] Appl. No.: 537,679

[22] PCT Filed: Apr. 14, 1994

[86] PCT No.: PCT/SE94/00329

§ 371 Date: Jan. 16, 1996

§ 102(e) Date: Jan. 16, 1996

[87] PCT Pub. No.: WO94/23616

PCT Pub. Date: Oct. 27, 1994

[30] Foreign Application Priority Data

Apr. 20, 1993 [SE] Sweden ..... 9301286

[51] Int. Cl.[6] ..... A47C 7/54

[52] U.S. Cl. ..... 297/411.38; 297/411.37; 297/411.36; 248/118.3; 248/289.31

[58] Field of Search ..... 297/411.38, 411.31, 297/411.32, 411.34, 411.35, 411.37; 248/118.3, 118, 279.1, 289.31

[56] References Cited

U.S. PATENT DOCUMENTS 3,929,309 12/1975 De Vore ..... 248/118
5,029,941 7/1991 Twisselmann ..... 297/411.38
5,143,422 9/1992 Althofer et al. ..... 297/411
5,407,249 4/1995 Bonutti ..... 297/411.38 X

FOREIGN PATENT DOCUMENTS 0 005 556 11/1979 European Pat. Off. .
459 313 6/1989 Sweden .

*Primary Examiner*—Laurie K. Cranmer
*Attorney, Agent, or Firm*—Kane, Dalsimer, Sullivan, Kurucz, Levy, Eisele and Richard, LLP

[57] ABSTRACT

An armrest device for an office chair comprises a fastening element (6) intended to be fixed to the chair beside the seat (4). The-device further includes an armrest (7, 8, 9, 20) which is connected to the fastening element (6) and has a vertical column (7) so connected to the fastening element as to be rotatable about its longitudinal axis, a horizontal rear supporting bar (8) connected to the column, and a front supporting bar (9) carrying a forearm rest (20), on which the user's forearm is to rest, and being telescopically displaceable in relation to the rear supporting bar (8) in order to form an armrest that can be lengthened and shortened as desired. The rear supporting bar (8) is so mounted on the column (7) as to be pivotable about a horizontal transverse axis (10). A spring means (15, 16, 17, 18, 19) is arranged to maintain the rear supporting bar (8) in an initial position and to counteract, with an adjustable spring pressure, pivotal movement of the rear supporting bar (8) about the horizontal transverse axis (10) caused by a depression of The forearm rest (20).

2 Claims, 1 Drawing Sheet

ARM-REST DEVICE FOR A CHAIR

Figure 1:
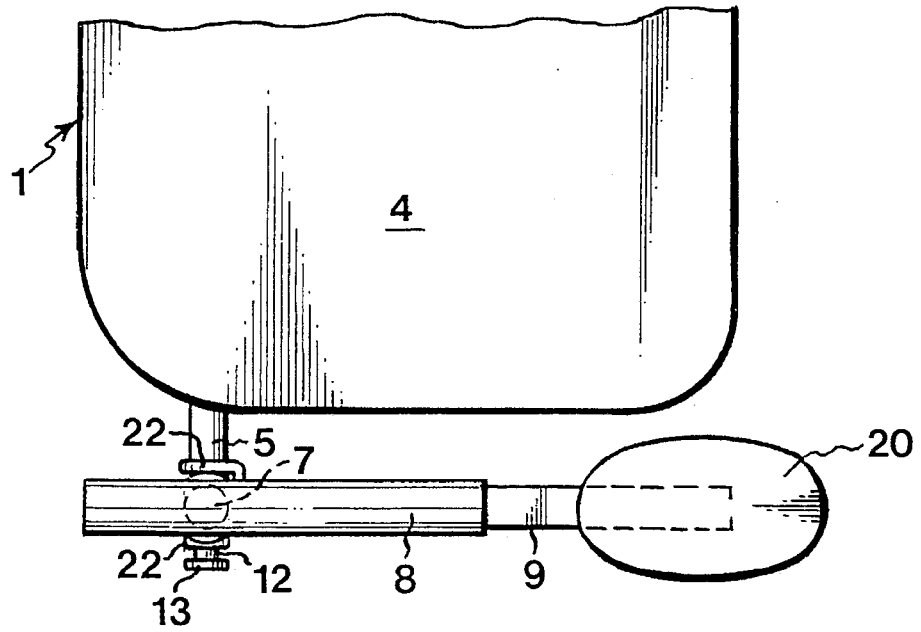

This invention relates to an armrest device for a chair, especially an office chair, the device comprising a fastening element adapted to be fixed to the chair beside the seat thereof, as well as an armrest connected to the fastening element.

In a prior-art armrest device of this type, the armrest has a horizontal rear supporting bar, which is so connected to the fastening element as to be pivotable about a vertical axis, and a horizontal front supporting bar, which is movably connected to the rear supporting bar and carries a forearm rest, on which the user's forearm is to rest. The rear end of the front supporting bar is articulated to the front end of the rear supporting bar, so that the two supporting bars are pivotable in relation to one another about a vertical axis. The forearm rest, which is provided at the front end of the front supporting bar, is tiltable about an axis that extends transversely of the front supporting bar and pivotable about a vertical axis. One armrest device is to be mounted on each side of the chair.

This known armrest device has been developed for the specific purpose of eliminating the shoulder and back-of-the-head strains from which office employees spending most of their time in front of a typewriter, a word processor, a computer or the like often suffer and which, in many cases, cause severe pain. Although the known armrest device has proved successful in this respect, it is a somewhat complicated, and hence expensive, device. Furthermore, this device is disadvantageous by requiring a considerable operating space on the side of the chair where The armrest device is mounted.

There is, however, a simple and inexpensive armrest device which does not suffer from this drawback. Like The armrest device described in the foregoing, this other device comprises an armrest that has a horizontal rear supporting bar, which is so connected to the fastening element as to be rotatable about a vertical axis, and a horizontal front supporting bar, which is movably connected to the rear supporting bar and carries a forearm rest, on which the user's forearm is to rest. The two supporting bars are telescopically displaceable in relation to one another in order to form an armrest that can be lengthened and shortened as desired, for which reason this armrest device requires less space.

The object of the present invention is to improve the last-mentioned armrest device, such that it can be adjusted to meet the needs of different users, thus offering each particular user optimum working conditions in respect of strain.

According to the invention, this object is achieved by an armrest device for a chair, especially an office chair, said device comprising a fastening element, which is adapted to be fixed to the chair beside the seat thereof, and an armrest, which is connected to the fastening element and has a substantially vertical column so connected to the fastening element as to be rotatable about its longitudinal axis, a substantially horizontal rear supporting bar connected to the column, and a front supporting bar carrying a forearm rest, on which the user's forearm is to rest, and being telescopically displaceable in relation to the rear supporting bar in order to form an armrest that can be lengthened and shortened as desired, said device being characterised in that the rear supporting bar is so mounted on the column as to be pivotable about a substantially horizontal transverse axis, and that a spring means is adapted to maintain the rear supporting bar in an initial position as regards its pivotal movement about the horizontal transverse axis and to counteract, with an adjustable spring pressure, pivotal movement of the rear supporting bar from this initial position caused by a depression of the forearm rest, said spring means comprising a threaded rod which is articulated to the rear supporting bar and extends through a part fixedly connected to the column, a spring arranged on the rod between said part and an adjusting nut screwed on the rod for adjusting the pressure exerted by the spring, and a stop nut screwed on the rod for setting the initial position.

In a preferred embodiment, a spring is arranged between the armrest and the fastening element to return the column to a preset initial position after it has been rotated about its longitudinal axis from this position.

Figure 2:
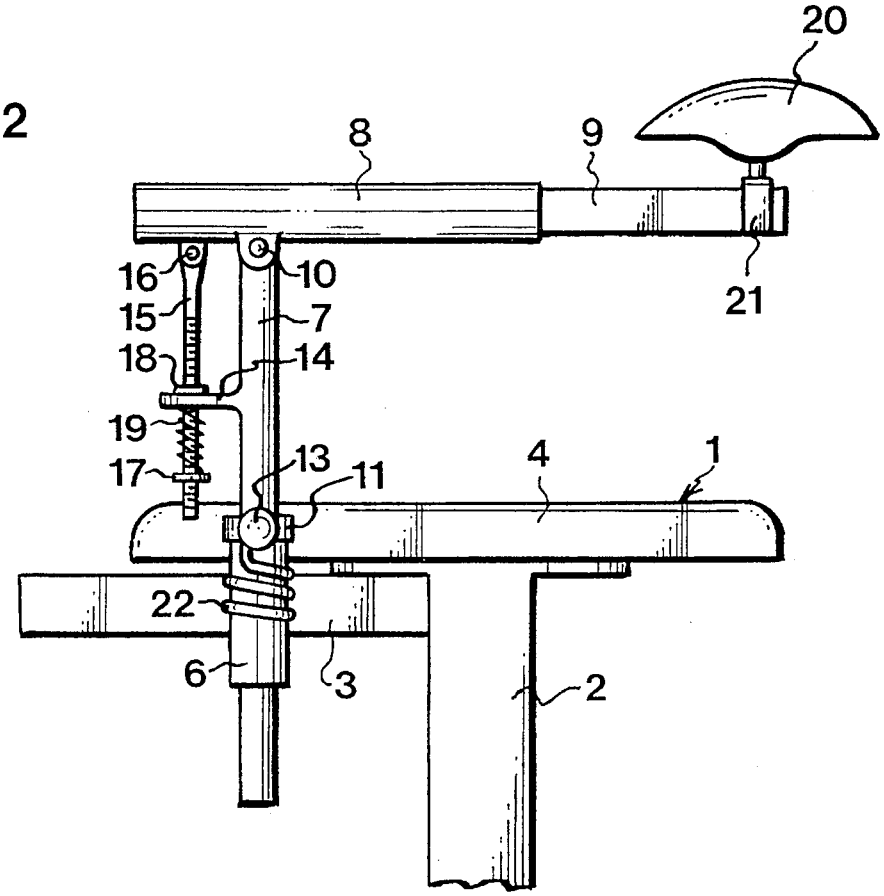

The invention will now be described in more detail with reference to the accompanying drawing, in which FIG. 1 is a top view of an armrest device according to the invention, and FIG. 2 is a side view of the armrest device.

In the drawing, the armrest device according to the invention is mounted on an office chair 1 (only schematically shown). The office chair 1 has a base column 2 supporting a frame 3, which carries the seat 4 and the back (not shown) of the chair. On both sides of the office chair 1, the frame 3 has a horizontal tubular frame element (not shown) which is located on a level with the rear portion of the seat 4 and extends in the transverse direction of the chair. The office chair 1 is provided with an armrest device on each side. For reasons of clarity, however, only the right-hand armrest device is shown in the drawing.

In the description, as well as in the appended claims and abstract, the words "horizontal", "vertical", "front"and "rear"relate to the position of the armrest device when mounted on the office chair 1.

The armrest device has a fastening element which consists of a horizontal bar 5 and a vertical sleeve 6 arranged at one end thereof. The fastening element 5, 6 is mounted on the frame 3 of the office chair 1 by the bar 5 being introduced a certain distance into the tubular element of the frame 3 and fixed in the desired position therein by means of a locking screw (not shown).

Furthermore, the armrest device includes an armrest which consists of a vertical column 7, a horizontal rear supporting bar 8 pivotably connected to the column 7, and a horizontal front supporting bar 9 movably connected to the rear supporting bar 8. The rear supporting bar 8 is connected to the column 7 by a transverse horizontal pivot pin 10, about which it pivots in relation to the column. The column 7 is rotatably mounted in the sleeve 6, and its vertical position therein can be adjusted by means of a locking ring 11 which is displaceable along the column and can be fixed in the desired position by means of a locking screw 12 with a knob-shaped head 13. Thus, the armrest device is pivotable about the axis defined by the sleeve 6.

The column 7 has a rear projection 14. A rod 15, which is articulated to the rear supporting bar 8 by a pin 16 parallel to the pivot pin 10, extends displaceably through a hole in the projection 14. The rod 15 is threaded along the major part of its length. An adjusting nut 17 is screwed on the bottom portion of the rod 15, and a stop nut 18 is screwed on the top portion thereof. A compression spring 19 is passed onto the rod 15 and abuts against the projection 14 at its top end and against the adjusting nut 17 at its bottom end. The spring pressure is adjusted with the aid of the adjusting nut 17. The spring 19 strives to pull the rod 15 downwards, thereby to pivot the rear supporting bar 8 anti-clockwise, as seen in FIG. 2. The end position is defined by the stop nut 18.

The rear supporting bar 8 is made up of a tube to which the front supporting bar 9 is telescopically connected. Conveniently, the front supporting bar 9 is made up of a fixed guide member, which with a close fit is inserted into the tube 8, and a movable guide member, which is easily displaceable in relation to the fixed guide member. Conveniently, such a supporting bar is a device of the type marketed by Herrich Skandinaviska AB under the trade name Expansion KA 270/350. The fixed guide member is sluggishly rotatable in the tube 8 to enable setting of the desired rotational position of the front supporting bar 9.

At the front end, the front supporting bar 9 carries a bowl-shaped forearm rest 20, on which the user's forearm is to rest. The forearm rest 20 is made of soft polyurethane. A U-shaped element 21, which is turned upsidedown, is welded over the front supporting bar 9. A sleeve (not shown), which opens at the underside of the forearm rest 20, is embedded in the polyurethane material. The web of the U-shaped element 21 has an upwardly-directed pin (not shown) extending into the sleeve. As a result, the forearm rest 20 is rotatable about the pin.

With the aid of The stop nut 18, the user of the armrest device sets a suitable initial position for the armrest (normally the position shown in FIG. 2, in which the supporting bars 8 and 9 are horizontal) and sets, with the aid of the adjusting nut 17, a suitable pressure for the spring 19. This spring pressure, which determines the pressure required for pivoting the rear supporting bar 8 clockwise (as seen in FIG. 2) about the pivot pin 10, is set at a value suitable for the user.

A helical spring 22 is arranged round the sleeve 6. One end of the helical spring 22 engages the locking screw 12, and the other end of the spring engages the horizontal bar 5. The helical spring 22 is so arranged that it strives by exerting a slight force to maintain the armrest in such a rotational position that the supporting bars 8 and 9 are directed straight forwards, as shown in FIG. 1. If the user swings the armrest outwards or inwards from this position, e.g. when he or she gets out of the chair 1, and then lets go of the armrest, the latter will be returned to the position shown in FIG. 1 by the helical spring 22. Another reference rotational position than the one shown in FIG. 1 may, if so desired, be obtained simply by loosening the locking screw 12 and turning the armrest slightly in relation to the locking ring 11, whereupon the looking screw 12 again is tightened.

The armrest device described above is of simple construction. Because the front supporting bar 9 travels readily in the rear supporting bar 8 and the column 7 is easily rotated in the sleeve 6, the user may, with his or her forearm resting on the forearm rest 20, expediently set the device in the desired position and just as easily adjust the set position when so required. Moreover, the armrest device is easily adapted to meet the needs of different users as regards the vertical resilience produced by the spring 19. As a result of the inventive arrangement, the armrest device offers the user a most favourable working posture in respect of strain.

I claim:

1. An armrest device for a chair, especially an office chair, said device comprising a fastening element (5, 6), which is adapted to be fixed to the chair beside the seat (4) thereof, and an armrest (7, 8, 9, 20), which is connected to the fastening element and has a substantially vertical column (7) so connected to the fastening element as to be rotatable about its longitudinal axis, a substantially horizontal rear supporting bar (8) connected to the column, and a front supporting bar (9) carrying a forearm rest (20), on which the user's forearm is to rest, and being telescopically displaceable in relation to the rear supporting bar (8) in order to form an armrest that can be lengthened and shortened as desired, characterised in that the rear supporting bar (8) is so mounted on the column (7) as to be pivotable about a substantially horizontal transverse axis (10), and that a spring means (15, 16, 17, 18, 19) is adapted to maintain the rear supporting bar (8) in an initial position as regards its pivotal movement about the horizontal transverse axis (10) and to counteract, with an adjustable spring pressure, pivotal movement of the rear supporting bar (8) from this initial position caused by a depression of the forearm rest (20), said spring means (15, 16, 17, 18, 19) comprising a threaded rod (15) which is articulated to the rear supporting bar (8) and extends through a part (14) fixedly connected to the column (7), a spring (19) arranged on the rod (15) between said part (14) and an adjusting nut (17) screwed on the rod (15) for adjusting the pressure exerted by the spring (19), and a stop nut (18) screwed on the rod (15) for setting the initial position.

2. An armrest device as claimed in claim 1, characterised in that a spring (22) is arranged between the armrest (7, 8, 9, 20) and the fastening element (5, 6) to return the column (7) to a preset initial position after it has been rotated about its longitudinal axis from this position.

* * * * *